US007257194B2

(12) United States Patent
Smith

(10) Patent No.: US 7,257,194 B2
(45) Date of Patent: Aug. 14, 2007

(54) CATHODE HEAD WITH FOCAL SPOT CONTROL

(75) Inventor: Ricky Smith, Sandy, UT (US)

(73) Assignee: Varian Medical Systems Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/776,540

(22) Filed: Feb. 9, 2004

(65) Prior Publication Data

US 2005/0175152 A1 Aug. 11, 2005

(51) Int. Cl.
*H01J 35/06* (2006.01)
*H01J 35/14* (2006.01)
*H01J 35/00* (2006.01)

(52) U.S. Cl. ..... 378/136; 378/138; 378/119

(58) Field of Classification Search ..... 378/119, 378/121, 125, 134, 136, 137, 138, 143, 144, 378/113; 313/421, 442
See application file for complete search history.

(56) References Cited

U.S. PATENT DOCUMENTS 3,250,916 A 5/1966 Rogers
3,783,333 A 1/1974 Atlee
3,875,028 A 4/1975 Atlee et al.
3,916,202 A 10/1975 Heiting et al.
3,962,583 A 6/1976 Holland et al.
4,064,352 A * 12/1977 Mann ..... 373/13
RE30,082 E 8/1979 Atlee et al.
4,373,144 A 2/1983 Franke
4,631,744 A * 12/1986 Haberrecker ..... 378/138
4,689,809 A 8/1987 Sohval
4,764,947 A 8/1988 Lesensky
4,819,260 A * 4/1989 Haberrecker ..... 378/137
5,125,019 A * 6/1992 Evain et al. ..... 378/137
5,222,114 A * 6/1993 Kamata et al. ..... 378/143
5,224,143 A * 6/1993 Dumitrescu et al. ..... 378/136
5,313,510 A 5/1994 Ebersberger et al.
5,548,630 A * 8/1996 Hell et al. ..... 378/137
5,550,889 A 8/1996 Gard et al.
5,689,542 A 11/1997 Lavering et al.
5,812,632 A 9/1998 Schardt et al.
5,898,755 A 4/1999 Meusel et al.
6,055,294 A * 4/2000 Foerst et al. ..... 378/138
6,091,799 A 7/2000 Schmidt
6,111,934 A * 8/2000 Foerst et al. ..... 378/137
6,115,454 A 9/2000 Andrews et al.
6,128,367 A 10/2000 Foerst et al.
6,181,771 B1 1/2001 Hell et al.
6,252,935 B1 6/2001 Styrnol et al.
6,292,538 B1 9/2001 Hell et al.
6,339,635 B1 1/2002 Schardt et al.

(Continued)

*Primary Examiner*—Edward J. Glick
*Assistant Examiner*—Irakli Kiknadze
(74) *Attorney, Agent, or Firm*—Workman Nydegger

(57) ABSTRACT

A cathode head is provide that is suitable for use in an x-ray device that includes an anode having a target surface configured and arranged to receive electrons emitted by the cathode head. The cathode head may be constructed of magnetic or non-magnetic material and includes an emitter block carrying a filament that defines a longitudinal axis about which is disposed one or more magnetic coils. The filament is configured and arranged to emit an electron beam that defines a focal spot on the target surface of the anode. The magnetic coil, or coils, disposed about the longitudinal axis defined by the filament generate a magnetic field that enables control of the location of the focal spot on the target surface of the anode.

35 Claims, 4 Drawing Sheets

U.S. PATENT DOCUMENTS 6,438,207 B1 * 8/2002 Chidester et al. ..... 378/138
6,529,579 B1 3/2003 Richardson
6,968,039 B2 * 11/2005 Lemaitre et al. ..... 378/138
2006/0050850 A1 3/2006 Andrews et al. ..... 378/119

* cited by examiner

CATHODE HEAD WITH FOCAL SPOT CONTROL

RELATED APPLICATIONS

Not applicable.

BACKGROUND OF THE INVENTION

1. Field of the Invention

The present invention relates generally to x-ray systems and devices. More particularly, embodiments of the invention concern a cathode head that includes features directed to facilitating implementation of focal spot control.

2. Related Technology

It is often desirable in various types of x-ray tubes to be able to deflect the beam of electrons emitted by the cathode, or other emitter, so that the focal spot created by the electron beam can be located at a particular place on the target surface of the anode at which the electron beam is directed. In some instances, the position of the focal spot on the target surface of the anode must be adjusted in order compensate for any changes to the focal spot location that may have resulted from environmental factors, or factors relating to the operation of the x-ray tube.

By way of example, the high speed motion associated with the operation of rotating anode x-ray tubes may cause undesirable variations to a location of the focal spot on the target surface. Further, misalignment of the focal spot on the target surface of the anode can occur over a period of time as the parts of the x-ray device experience operational wear and tear. A variety of other conditions or advance may likewise cause undesirable changes to the desired position of the focal sport on the target surface of the anode.

In yet other cases, it is desirable to move the position of the focal spot on the target surface of the anode so as to achieve a particular x-ray emissive effect or to overcome certain conditions that may be present. Accordingly, the ability to achieve and/or maintain such a desired effect is materially compromised by uncontrolled changes to the position of the focal spot. As an example, it may be desirable in some instances to modify the position of the focal spot in order to compensate for any localized deterioration or other shortcomings in the target surface of the anode. Finally, modification of the position of the focal spot on the target surface of the anode may be necessary in some instances to compensate for local electrical and/or magnetic effects.

Various systems and components have been devised in an effort to attain and maintain effective and reliable focal spot placement and control. For example, deflection of the emitted electron beam and, thus, changes to the position of the focal spot on the target surface of the anode may be implemented through the use of magnetic coils, or electromagnets located on the outside of the x-ray tube.

One significant problem with this type of implementation is that a relatively high level power is required to create the magnetic field necessary to move the focal spot to a desired location or position. Such high power levels relate to the fact that magnetic field strength diminishes over distance. In particular, magnetic coils located on the outside of the x-ray tube, or at other locations well away from the electron beam, require relatively more power to implement a particular electron beam effect than would a magnetic coil, or coils, located relatively closer to the electron beam.

Moreover, known x-ray tube configurations, and cathode assemblies and devices in particular, largely preclude arrangement of a magnetic coil near the electron beam.

Further, it is not feasible to locate magnetic coils near the anode due to the high operating temperature of the anode and the presence of x-rays and backscatter electrons that could impair the operation of the coil.

Accordingly, what is needed is a cathode head that includes one or more magnetic elements that are located proximate the emitter so as to enable reliable control of electron beam focal spot location without requiring a significant amount of operational power.

BRIEF SUMMARY OF AN EXEMPLARY EMBODIMENT OF THE INVENTION

In general, embodiments of the invention are concerned with a cathode head that includes features directed to facilitating implementation of focal spot control. More particularly, exemplary embodiments of the invention are directed to a cathode head that includes one or more magnetic elements that are located proximate an emitter, such as a filament, of the cathode so as to enable control of the location of the focal spot defined by an electron beam generated by the emitter.

In one exemplary embodiment of the invention, a cathode head is provide that is suitable for use in an x-ray device that includes an anode having a target surface configured and arranged to receive an electron beam from the cathode head. The cathode head may be constructed of magnetic or non-magnetic material and includes an emitter block carrying a filament that defines a longitudinal axis about which is disposed one or more magnetic elements, such as electromagnets. The filament is configured and arranged to emit an electron beam that defines a focal spot on the target surface of the anode.

In operation, the magnetic coils disposed about the longitudinal axis defined by the filament generate a magnetic flux that is generally perpendicular to the emitted electron beam and, thus, imparts a desired deflection to the electron beam. Alterations to the magnetic flux density, for example, associated with the magnetic coils, changes the extent to which the emitted electron beam is deflected and, thus, the location of the focal spot on the target surface of the anode. Moreover, the relatively close proximity of the magnetic coils with the filament enables a given electron beam deflection to be achieved using relatively weaker magnetic fields than would be required if the filament and magnetic coils were spaced some distance apart.

These and other, aspects of embodiments of the present invention will become more fully apparent from the following description and appended claims.

BRIEF DESCRIPTION OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF SELECTED EMBODIMENTS OF THE INVENTION

Reference will now be made to the drawings to describe various aspects of exemplary embodiments of the invention. It is to be understood that the drawings are diagrammatic and schematic representations of such exemplary embodiments, and are not limiting of the present invention, nor are they necessarily drawn to scale.

In general, embodiments of the invention are concerned with a cathode head that includes one more magnetic elements that enable directional control of an electron beam generated by an associated emitter such as a filament. In this way, exemplary embodiments of the invention are able to effectively and reliably control the location of an electron beam focal spot on a target surface of an associated anode.

Figure 1:
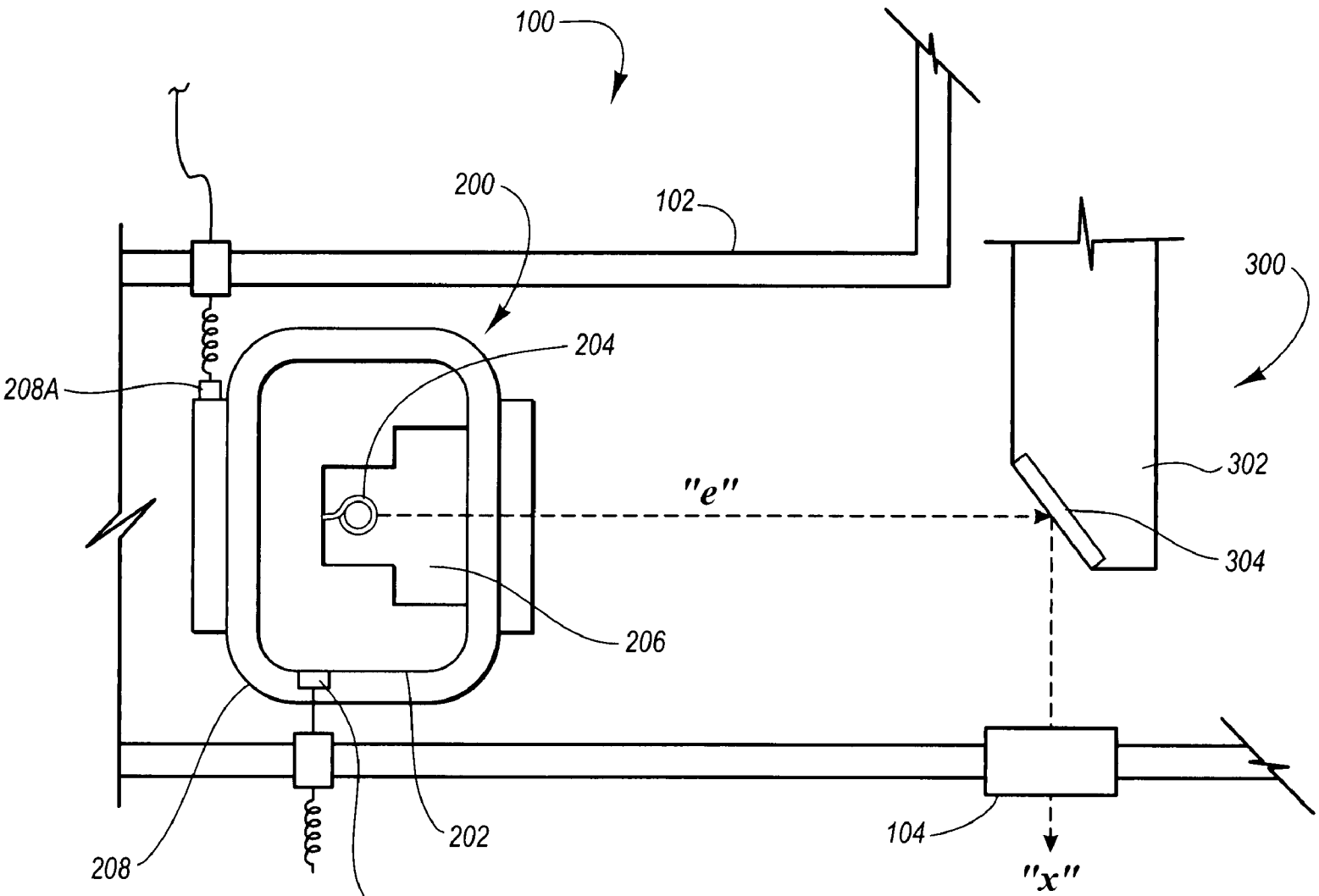
FIG. 1 is a top view of an x-ray device that includes an anode arranged to receive an electron beam emitted by an exemplary implementation of a cathode head.

Directing particular attention now to FIG. 1, details are provided concerning various aspects of an exemplary operating environment for embodiments of the invention. One such exemplary operating environment comprises an x-ray device, denoted generally at 100 in FIG. 1. Generally, the x-ray device 100 includes an evacuated, or vacuum, enclosure 102 within which are disposed a cathode head 200 and anode 300. In general, the cathode head 200 and anode 300 are arranged so that an electron beam emitted by the cathode head 200 impacts the anode head 300 so as to produce x-rays that are then transmitted through a window 104 positioned in the vacuum enclosure 102.

With more particular reference now to FIG. 1, the illustrated exemplary implementation of the cathode head 200 includes an emitter block 202 that, exemplarily, comprises a non-electrically conductive material such as ceramic. The emitter block 202 is generally configured to receive one or more electron emitters, exemplarily implemented as a filament 204. Generally, the filament 204 is situated within the emitter block 202 in such a way that electrons emitted from the filament 204 pass through an opening 206 defined by the emitter block 202. The shape of the opening 206, as well as the arrangement of the filament 204 within the opening 206, can be varied in order to achieve certain effects with respect to the emitted electron beam. Accordingly, the illustrated configuration and arrangement is exemplary only and is not intended to limit the scope of the invention in any way.

With continuing attention to FIG. 1, the emitter block 202 of cathode head 200 further includes an electrical connector 202A by way of which power is applied to the filament 204. Generally, transmission of power to the filament 204 by way of the electrical connection 202A results in the thermionic emission of electrons from the filament 204.

The illustrated implementation of the cathode head 200 further includes one or more magnetic elements 208 arranged with respect to the filament 204 such that a magnetic field having a desired magnetic flux density "B" and orientation is created. As suggested in FIG. 1, some implementations of the cathode head 200 include a magnetic element 208 implemented as an electromagnet. In other implementations however, permanent magnets are employed in place of electromagnets. Where electromagnets are employed, the cathode head 200 further includes an electrical connection 208A by way of which power is supplied to the magnetic element 208. As discussed in further detail below, modulation of the power supply to the magnetic element 208 can be used to achieve various effects with regard to the positioning of the focal spot defined by the electron beam.

As noted earlier, the exemplary implementation of the x-ray device 100 includes anode 300 positioned to receive the electron beam generated by the filament 204 of the cathode head 200. More particularly, the anode 300 includes a substrate 302 upon which a target surface 304 is positioned. In an exemplary implementation of the anode 300, the substrate 302 substantially comprises a carbon-based material or carbon compound, while the target surface 304 substantially comprises tungsten and/or other metals or compounds effective in generating x-rays.

It should be noted that embodiments of the cathode 200 are suitable for use in connection with a variety of different types of anodes 300. For example, embodiments of the cathode head 200 are suitable for use in connection both with rotating anode type x-ray devices, as well as with stationary anode type x-ray devices. Accordingly, the scope of the invention should not be construed to be limited to any particular anode or x-ray device configuration.

Figure 2:
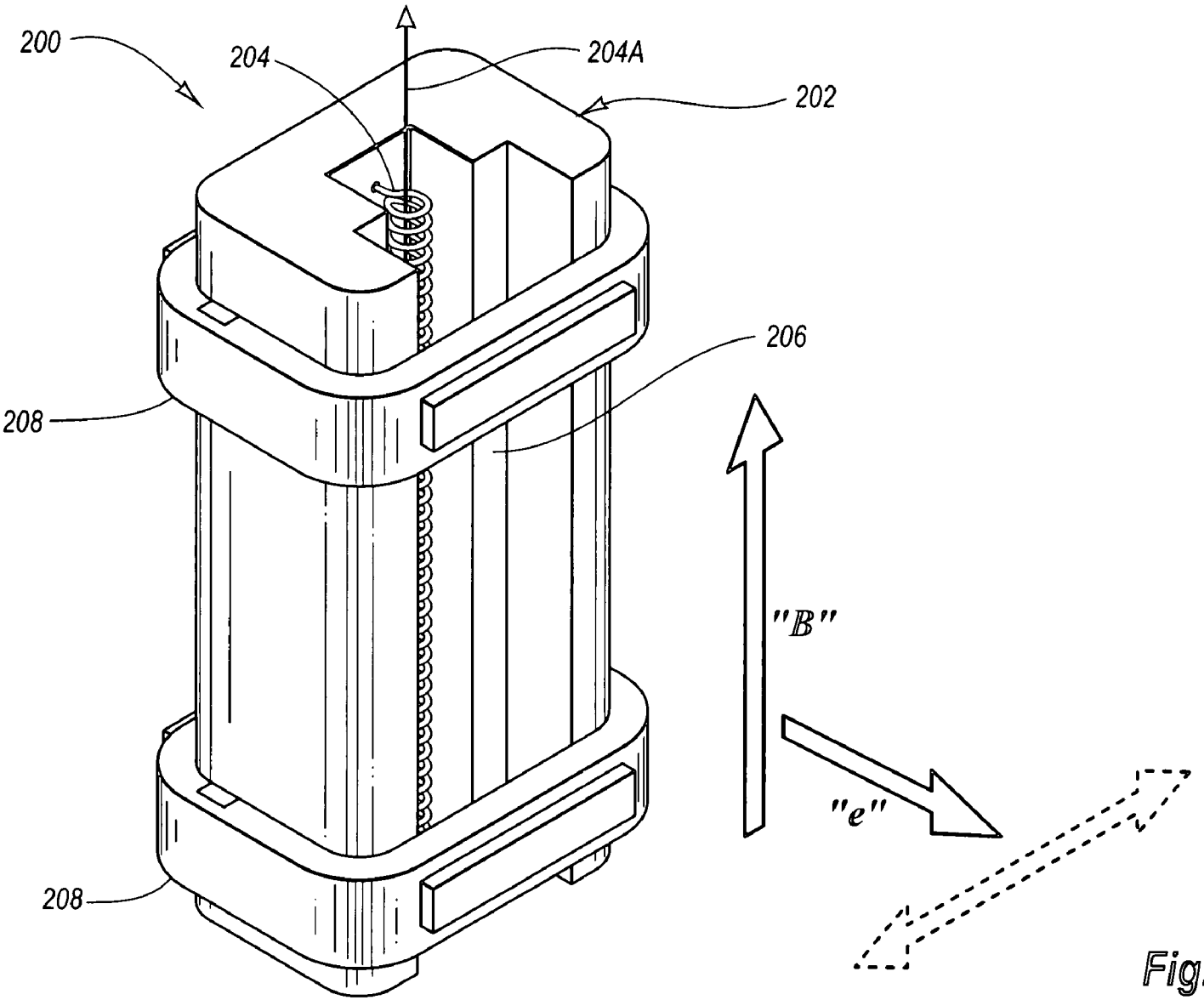
FIG. 2 is a side perspective view of an exemplary implementation of a non-magnetic cathode head that includes a pair of magnetic coils.

With attention now to FIG. 2, further details or provided concerning an exemplary implementation of a cathode head 200. In the exemplary embodiment illustrated in FIG. 2, the emitter block 202 substantially comprises a non-magnetic material. Examples of suitable non-magnetic materials that may be used in the construction of emitter block 202 include, but are not limited to, ceramic materials. In the illustrated implementation, two magnetic elements 208 are disposed in a spaced-apart arrangement about a longitudinal axis 204A defined by the filament 204. As suggested in FIG. 2, the effect of the placement of magnetic elements 208 in this way is the generation of a magnetic field of magnetic flux density B oriented as indicated. That is, the magnetic elements 208 cooperate to define the magnetic field of magnetic flux density B, as a consequence of the specific arrangement of the magnetic elements 208 with respect to each other and with respect to the longitudinal axis 204A defined by the filament 204.

With continuing reference to FIG. 2, the establishment of the magnetic field indicated, considered in connection with the direction of travel of the electrons emitted by the filament 204, results in the ability, through the control of the magnetic field, to deflect the electron beam laterally, as indicated. Moreover, varying the input power to one or both of the magnetic elements 208, in the event that the magnetic elements 208 are embodied as electromagnets, enables reliable control over the extent to which the electron beam is laterally deflected and, thus, the location of the focal spot. Further details concerning exemplary focal spot effects are considered below in connection with the discussion of FIG. 4.

As suggested by the foregoing discussion of FIG. 2, a variety of factors influence the extent to which the electron beam and, thus, the position of the focal spot, is affected by the magnetic elements 208. As suggested above for example, varying the input power to the magnetic elements 208 enables the user to adjust the magnetic flux B of the generated magnetic field, and thereby modify the extent to which the electron beam is laterally deflected and the focal position modified.

As another example, modifications to the generated magnetic field, such as the strength and direction of the field, may be implemented by varying the arrangement of the magnetic elements 208 with respect to each other and/or with respect to the emitter block 202 and the filament 204. Thus, by modifying aspects of the generated magnetic field, changes to the positioning of the electron beam and, thus, the focal spot at which the electron beam impacts the target surface of the anode (see FIG. 1), can be readily implemented.

Moreover, the relatively close physical proximity between the filament 204 and the magnetic elements 208 enables desired beam deflection effects to be implemented with relatively less power than would otherwise be required if the magnetic elements 208 were located relatively further away from the electron beam, as is typical in many known devices. That is, because the strength of the magnetic field diminishes over distance, the input power to the magnetic elements 208 that is required to establish and maintain a magnetic field of desired strength, necessarily increases as the distance between the electron beam and the magnetic elements increases.

Other variables, as well, can be adjusted to achieve certain effects with respect to the focal spot of the electron beam admitted by the filament 204. By way of example, aspects such as the number and polarity of the magnetic elements 208 can be changed as necessary to achieve a desired effect.

Figure 3:
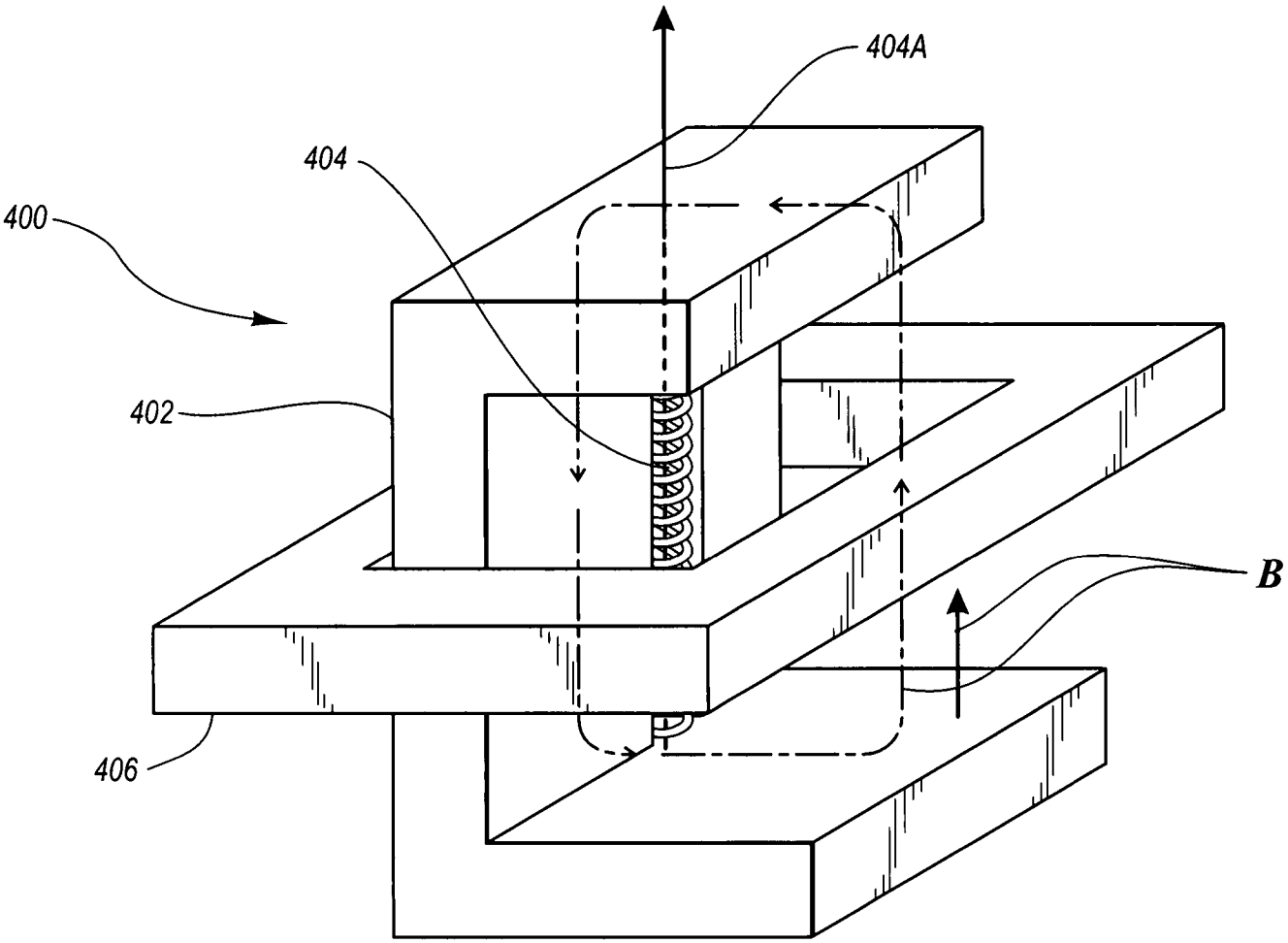
FIG. 3 is a side perspective view of an exemplary implementation of a FIG. 4 is a top view illustrating various exemplary electron beam effects achieved through the use of an exemplary implementation of a cathode head.

Directing attention now to FIG. 3, details are provided concerning an alternative implementation of the cathode head, denoted generally at 400. As indicated in FIG. 3, the cathode head 400 includes an emitter block 402 configured and arranged to carry an emitter, exemplarily implemented as filament 404 that, when energized, generates an electron beam. Of course, any other suitable emitter, or emitters, may be used in place of the filament 404. Moreover, the arrangement of the filament 404 with respect to the emitter block 402 may be varied as desired. In this exemplary implementation, the emitter block 402 substantially comprises a magnetic material such as steel or a steel alloy. Any other suitable magnetic material may alternatively be employed however.

With continuing reference to FIG. 3, the exemplary cathode head 400 further includes a single magnetic element 406 that is disposed about a longitudinal axis 404A defined by the filament 404. The magnetic element 406 may compromise either a permanent magnet or an electromagnet. Because the emitter block 402 substantially comprises magnetic material, only a single magnetic element 406 is required. More specifically, magnetic element 406 cooperates with the magnetic emitter block 402 to define a magnetic field of magnetic flux density B oriented as shown.

As suggested by FIG. 3, aspects such as, but not limited to, the geometry, materials, and orientation of the emitter block 402, as well as the orientation of emitter block 402 with respect to filament 404 and the magnetic element 406, may be varied as necessary to achieve a particular effect with respect to the focal snot of the electron beam generated by the filament 404.

Additionally, the positioning and orientation of the magnetic element 406 relative to the filament 404 and the emitter block 402, as well as the power applied to magnetic element 406, in implementations where the magnetic element 406 comprises an electromagnet, may be desirably modified to achieve a particular effect with respect to the control of the focal spot of the emitted electron beam.

Finally, the orientation of the emitter block 402 inside the vacuum enclosure (see FIG. 1) may be varied as desired to achieve a particular effect with respect to the positioning of the focal spot defined by the electron beam. Accordingly, the scope of the invention should not be construed to be limited to the exemplary implementations disclosed herein.

It should be noted that the various magnetic elements, or combinations of magnetic elements, disclosed herein comprise exemplary structural implementations of a means for facilitating focal spot control. However, any other structures or combinations thereof effective in implementing control of the location of the focal spot may alternatively be employed. Accordingly, the scope of the invention should not be construed to be limited to the exemplary structural implementations disclosed herein.

Figure 4:
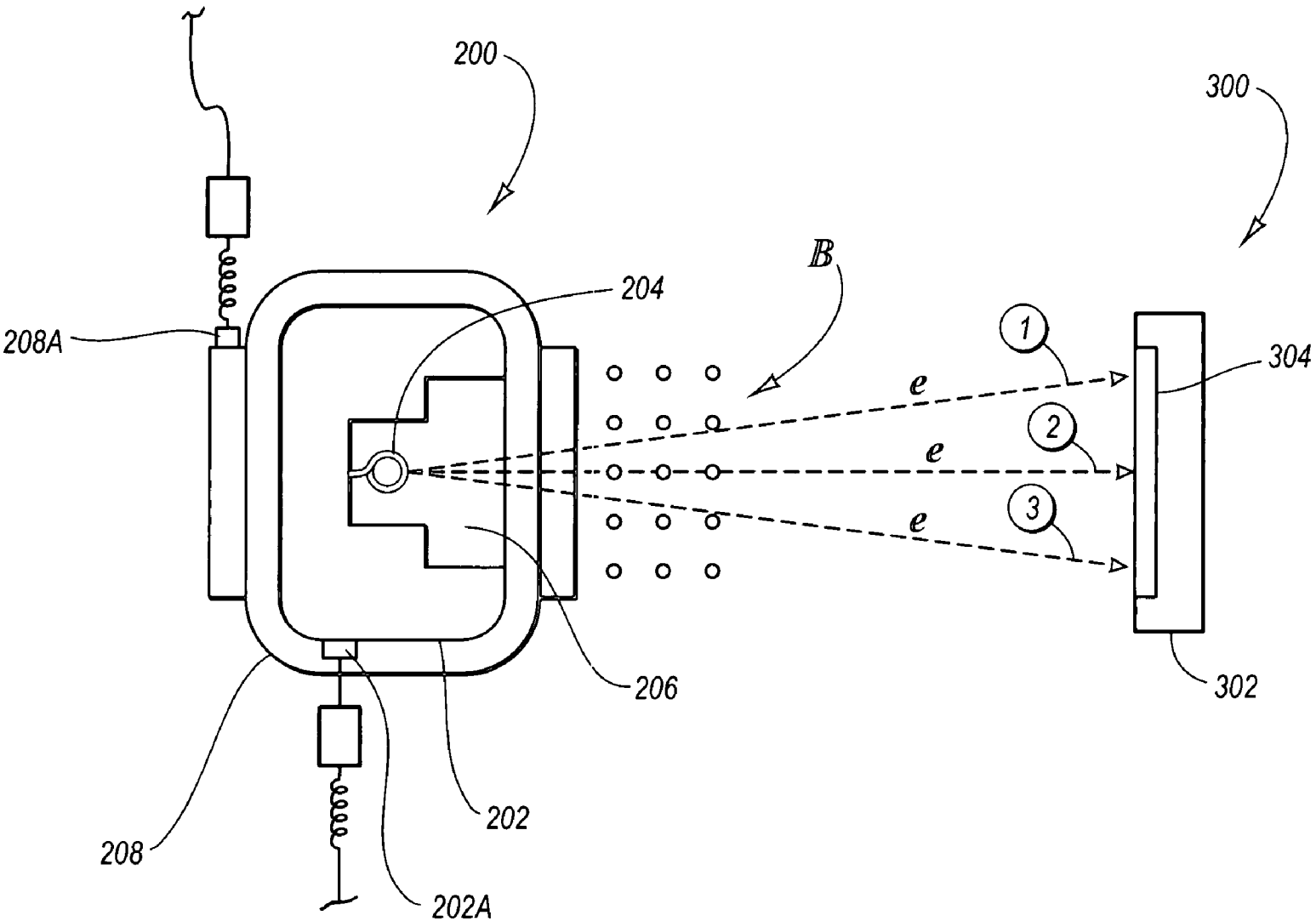

With attention now to FIG. 4, details are provided concerning operational aspects of the invention as they relate to implementation of various focal spot effects that may be achieved with exemplary embodiments of the cathode head. In operation, power supplied to the filament 204 by way of the electrical connection 202A causes the filament 204 to emit electrons by the process of thermionic emission. A potential to accelerate rapidly towards the target surface 304 of the anodes 300, impacting the target surface 304 and causing the generation of x-rays. At the same time, power supplied to the magnetic element 208, or magnetic elements 208, as applicable, causes the generation of a magnetic field having magnetic flux density B and positioned and oriented as indicated in FIG. 4.

That is, the flux lines that represent the magnetic flux density B of the magnetic field are generally oriented parallel to the filament 204 and generally perpendicular to the plane of the transmitted electron beam. As noted earlier, the strength and orientation of this magnetic field may be varied as desired to achieve a particular effect with respect to the location of the focal sport on the target surface 304 of the anode 300. Generally, this is due to the relationship between the magnetic field strength, or magnetic flux density, B and the force exerted on an electron passing through the magnetic field.

This relationship is sometimes expressed in the form $F=qv\times B$, where F is the force exerted on a particle, such as an electron, of charge q moving at a velocity v perpendicular to, and through, a magnetic field having a magnetic flux density B. As the foregoing relation makes clear, the force F exerted on an electron varies directly as a function of the magnetic flux density B, so that as flux density increases, the force exerted on electrons passing through the magnetic field increases accordingly.

As indicated in FIG. 4, exemplary implementations of the cathode head 200 are configured and arranged to enable lateral adjustment of the position of the focal spot on the target surface 304, where exemplary focal spot positions are represented at "1," "2" and "3." In other implementations, the magnetic elements 208 are configured and arranged to provide for a vertical displacement of the focal spot on the target surface 304. In yet other exemplary implementations, an arrangement of one or more magnetic elements 208 is employed that enables both vertical and lateral adjustments to the position of focal spot of the electron beam on the target surface 304. Of course, various other effects may be implemented as well with embodiments of the cathode head. Accordingly, the scope of the invention should not be construed to be limited to any particular type or nature of focal spot location adjustment.

The described embodiments are to be considered in all respects only as exemplary and not restrictive. The scope of the invention is, therefore, indicated by the appended claims rather than by the foregoing description. All changes which come within the meaning and range of equivalency of the claims are to be embraced within their scope.

What is claimed is:

1. A cathode head suitable for use in an x-ray device and the cathode head comprising:

an emitter block;

an emitter attached to the emitter block and configured to generate electrons of an electron beam, at least a portion of the emitter being positioned within the emitter block, and at least one magnetic element that defines an opening within which a portion of the emitter is positioned.

2. The cathode head as recited in claim 1, wherein the at least one magnetic element comprises at least one electromagnet.

3. The cathode head as recited in claim 1, wherein the at least one magnetic element comprises at least one permanent magnet.

4. The cathode head as recited in claim 1, wherein the emitter block is substantially non-magnetic.

5. The cathode head as recited in claim 1, wherein the emitter defines a longitudinal axis which extends through the opening defined by the at least one magnetic element.

6. The cathode head as recited in claim 1, wherein the at least one magnetic element comprises a pair of electromagnets, each of which defines an opening within which a respective portion of the emitter is positioned.

7. The cathode head as recited in claim 1, wherein the at least one magnetic element and the emitter block cooperate to create a magnetic field through which at least a portion of the electron beam passes.

8. The cathode head as recited in claim 1, wherein the emitter comprises at least one filament.

9. The cathode head as recited in claim 1, wherein the at least one magnetic element is arranged such that flux lines of a magnetic flux density B of a magnetic field associated with the at least one magnetic element are substantially perpendicular to a direction of travel of an electron beam generated by the emitter.

10. A cathode head suitable for use in an x-ray device and comprising:

a magnetic emitter block;

an emitter attached to the emitter block and configured to generate electrons for an electron beam that defines a focal spot; and means for facilitating focal spot control, wherein the means generates a magnetic field with a magnetic flux density B having flux lines that are substantially perpendicular to a direction of travel of the electron beam.

11. The cathode head as recited in claim 10, wherein the means for facilitating focal spot control serves to adjust a position of the focal spot.

12. The cathode head as recited in claim 10, wherein the means for facilitating focal spot control enables at least lateral adjustments to a position of the focal spot.

13. The cathode head as recited in claim 10, wherein the means for facilitating focal spot control implements an adjustable deflection of the electron beam.

14. The cathode head as recited in claim 10, wherein the means for facilitating focal spot control acts on the electron beam in a location proximate the emitter.

15. The cathode head as recited in claim 10, wherein the means for facilitating focal spot control cooperates with the emitter block to create a magnetic field through which at least a portion of the electron beam passes.

16. An x-ray device, comprising:

a vacuum enclosure;

an anode substantially disposed within the vacuum enclosure, the anode including a target surface; and a cathode head comprising the following elements, each of which is substantially disposed within the vacuum enclosure:

an emitter block;

an emitter attached to the emitter block and configured to emit electrons of an electron beam that defines a focal spot on the target surface of the anode; and at least one magnetic element that defines an opening within which a portion of the emitter is positioned.

17. The x-ray device as recited in claim 16, wherein the at least one magnetic element comprises a pair of magnets, each of which defines an opening within which a respective portion of the emitter is positioned.

18. The x-ray device as recited in claim 16, wherein the at least one magnetic element comprises a permanent magnet.

19. The x-ray device as recited in claim 16, wherein the emitter block is substantially non-magnetic.

20. The x-ray device as recited in claim 16, wherein the emitter block is magnetic.

21. The x-ray device as recited in claim 16, wherein the emitter defines a longitudinal axis which extends through the opening defined by the at least one magnetic element.

22. The x-ray device as recited in claim 16, wherein the at least one magnetic element and the emitter block cooperate to create a magnetic field through which at least a portion of the electron beam passes.

23. The x-ray device as recited in claim 16, wherein the anode is a rotating anode.

24. The x-ray device as recited in claim 16, wherein the anode is a stationary anode.

25. The x-ray device as recited in claim 16, wherein the at least one magnetic element is arranged such that flux lines of a magnetic flux density B of a magnetic field associated with the at least one magnetic element are substantially perpendicular to a direction of travel of an electron beam generated by the emitter.

26. A cathode head suitable for use in an x-ray device and comprising:

an emitter block;

a filament attached to the emitter block and defining a longitudinal axis, the filament being configured to emit electrons of an electron beam; and first and second magnetic elements that define respective openings within which the emitter block is positioned.

27. The cathode head as recited in claim 26, wherein the emitter block is substantially non-magnetic.

28. The cathode head as recited in claim 26, wherein the emitter block is magnetic.

29. The cathode head as recited in claim 26, wherein at least one of the magnetic elements comprises an electromagnet.

30. The cathode head as recited in claim 26, wherein a portion of the filament is positioned within one of the openings respectively defined by the magnetic elements.

31. The cathode head as recited in claim 26, wherein flux lines of a magnetic flux density B of a magnetic field associated with at least one of the magnetic elements are substantially perpendicular to a direction of travel of the electron beam.

32. The cathode head as recited in claim 26, wherein the emitter block substantially comprises ceramic.

33. The cathode head as recited in claim 26, wherein at least one of the magnetic elements comprises a permanent magnet.

34. The cathode head as recited in claim 26, wherein the first and second magnetic elements are disposed in a spaced apart arrangement with respect to each other.

35. A cathode head suitable for use in an x-ray, the cathode head comprising:

a magnetic emitter block;

an emitter attached to the magnetic emitter block; and at least one magnetic element arranged such that flux lines of a magnetic flux density B of a magnetic field associated with the at least one magnetic element are substantially perpendicular to a direction of travel of the electron beam.

* * * * *

UNITED STATES PATENT AND TRADEMARK OFFICE

CERTIFICATE OF CORRECTION

PATENT NO. : 7,257,194 B2
APPLICATION NO. : 10/776540
DATED : August 14, 2007
INVENTOR(S) : Smith It is certified that error appears in the above-identified patent and that said Letters Patent is hereby corrected as shown below:

Column 3
Line 5, after "of a", insert --magnetic cathode head that includes a single magnetic coil; and--

Column 5
Line 55, change "snot" to --spot--

Signed and Sealed this

Sixteenth Day of November, 2010

David J. Kappos

David J. Kappos
*Director of the United States Patent and Trademark Office*